United States Patent [19]

Aaldenberg et al.

[11] Patent Number: 4,987,690

[45] Date of Patent: Jan. 29, 1991

[54] CONVERTIBLE SWING ARM AND DESK TOP COPY HOLDER

[75] Inventors: Eric R. Aaldenberg, Bayside; Andrzej L. Soporowski, Freeport, both of N.Y.

[73] Assignee: Esselte Pendaflex Corporation, Garden City, N.Y.

[21] Appl. No.: 114,188

[22] Filed: Oct. 28, 1987

[51] Int. Cl.[5] ..... B41J 11/00

[52] U.S. Cl. ..... 40/341; 40/352; 248/447; 248/281.1; 248/447.2

[58] Field of Search ..... 40/352, 341, 152.1, 40/354, 357, 658; 248/447.2, 447, 457, 281.1, 297.3, 279, 469, 476, 223.4, 222.4, 224.2; 24/67.11; 33/448

[56] References Cited

U.S. PATENT DOCUMENTS

| | | | |
|---|---|---|---|
| 768,483 | 8/1904 | Rivers | 248/457 |
| 2,335,896 | 12/1943 | Anderson | 248/476 |
| 2,538,318 | 1/1951 | Mitchell | 40/152 |
| 3,081,739 | 3/1963 | Mendels | 40/352 |
| 3,908,297 | 9/1975 | Schmutzler et al. | 40/617 |
| 4,213,591 | 7/1980 | Jaakkola | 248/281.1 |
| 4,365,431 | 12/1982 | Klaus et al. | 40/152.1 |
| 4,455,773 | 6/1984 | Denison | 40/352 |
| 4,568,052 | 2/1986 | Solomon et al. | 248/447 |

*Primary Examiner*—Cary E. Stone

*Attorney, Agent, or Firm*—Darby & Darby

[57] ABSTRACT

A convertible copy holder has tracks on its rear surface that allow it to be attached to a swing arm on a desk top brace as desired. Further, the holder is made hollow to provide a storage compartment. A rib is located along one edge of the copy holder to receive a line guide, which is structured so that it may be pivoted from the copy surface. Also, there is a channel along the top of the copy holder which receives, and slidably retains, a large paper clip.

19 Claims, 4 Drawing Sheets

CONVERTIBLE SWING ARM AND DESK TOP COPY HOLDER

TECHNICAL FIELD

The present invention relates to copy holders and, in particular, to a copy holder which can be suspended from a swing arm or positioned on a desk top.

BACKGROUND OF THE INVENTION

It is well known in business offices to employ copy holders to support drafts of documents while they are being typed. In the most typical situation the copy holder is like an easel which rests on the typist's desk adjacent a typewriter. An example of such a copy holder is shown in U.S. Pat. No. 4,267,656 of Solomon, which is assigned to the assignee of the present invention. In most cases the copy holder not only holds the document, it contains a line guide or ruler which can be moved down the text to indicate where the typist is in the document. Some copy holders can advance the line guide a line at a time by manually contacting a lever. Such a copy holder is shown in U.S. Pat. No. 2,763,241 of Waggoner and U.S. Pat. No. 2,642,841 of Funk.

Swing arms are support structures that generally include two pairs of parallel bars pivotally connected together. One end of the assembly is clamped to a stationary surface in such a manner that the pairs of arms may rotate about a vertical axis. The other end of the swing arm holds an object, e.g. a lamp, to be located at some position in space. Once in the desired position, clamps on the pivot joints cause the assembly to be locked in place.

While swing arms are most often used in the work place to position lamps, they may also be used to position documents, must like conventional copy holders. An example of a swing arm copy holder is disclosed in U.S. Pat. No. 4,568,052 of Soloman et al., which is assigned to the assignee of the present invention.

In most cases a conventional copy holder is most useful in the office because it is small in size and can be easily stored out of sight. However, if the print on the document being copied is small, it may be necessary to use a swing arm type copy holder to position the document close to the user's eyes. Further, when a computer terminal is used for typing, its associated disk drive and monitor may take up so much desk space that a conventional copy holder cannot be conveniently located, and a swing arm copy holder is required.

Copy holders are designed to hold papers 8½ inches wide and up to 14 inches long. However, frequently information incorporated in reports to be typed comes from computer sheets, which sheets are significantly wider than 8½ inches. Consequently, conventional copy holders are inadequate for supporting computer sheets.

It would be advantageous to have a copy holder which could be converted from the swing arm type to the desk type as needed, and which could also accommodate either conventional stationary or computer size paper.

SUMMARY OF THE INVENTION

The present invention is directed to a convertible copy holder which is adaptable between desk top and swing arm supports, and between a conventional stationary width and an extra wide width.

In an illustrative embodiment of the invention the copy holder has a copy support structure with a flat copy surface. The copy support structure may be part of a double wall hollow structure. The back of the copy support structure has a pair of vertical tracks with a series of horizontal grooves extending between them.

When used as a desk top copy holder, an inverted T-shaped brace with a twin tracked bracket at its upper end is utilized. The bracket tracks engage the tracks on the back of the copy support structure and a projecting finger from the bracket engages a selected one of the horizontal grooves, depending on the desired slope of the copy surface. This allows the copy holder to rest on a desk top in easel fashion and to be adjustable into various angular positions.

To form a swing arm copy holder, the inverted T-shaped brace is removed from the copy support structure. This brace is replaced with an elongated member having a pair of tracks that match and may engage the tracks on the back of the copy support structure. The lower end of this elongated member is cylindrical in shape and is rotatably received in the end of a conventional swing arm device.

The copy surface is wide enough to hold conventional stationary sizes. However, to accommodate wider paper, such as computer sheets, an auxiliary copy support may be snap fit onto the main copy support.

Documents may be held to the copy surface by a large flexible clip that fits into a channel along the upper edge of the copy surface and can be placed anywhere along the top edge of the copy surface. In addition, a line guide or ruler may be moved along one edge of the copy surface to indicate a position in the document. This line guide is self-adjusting to accommodate the thickness of the papers placed on the copy surface.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figures 1, 1A, 1B:
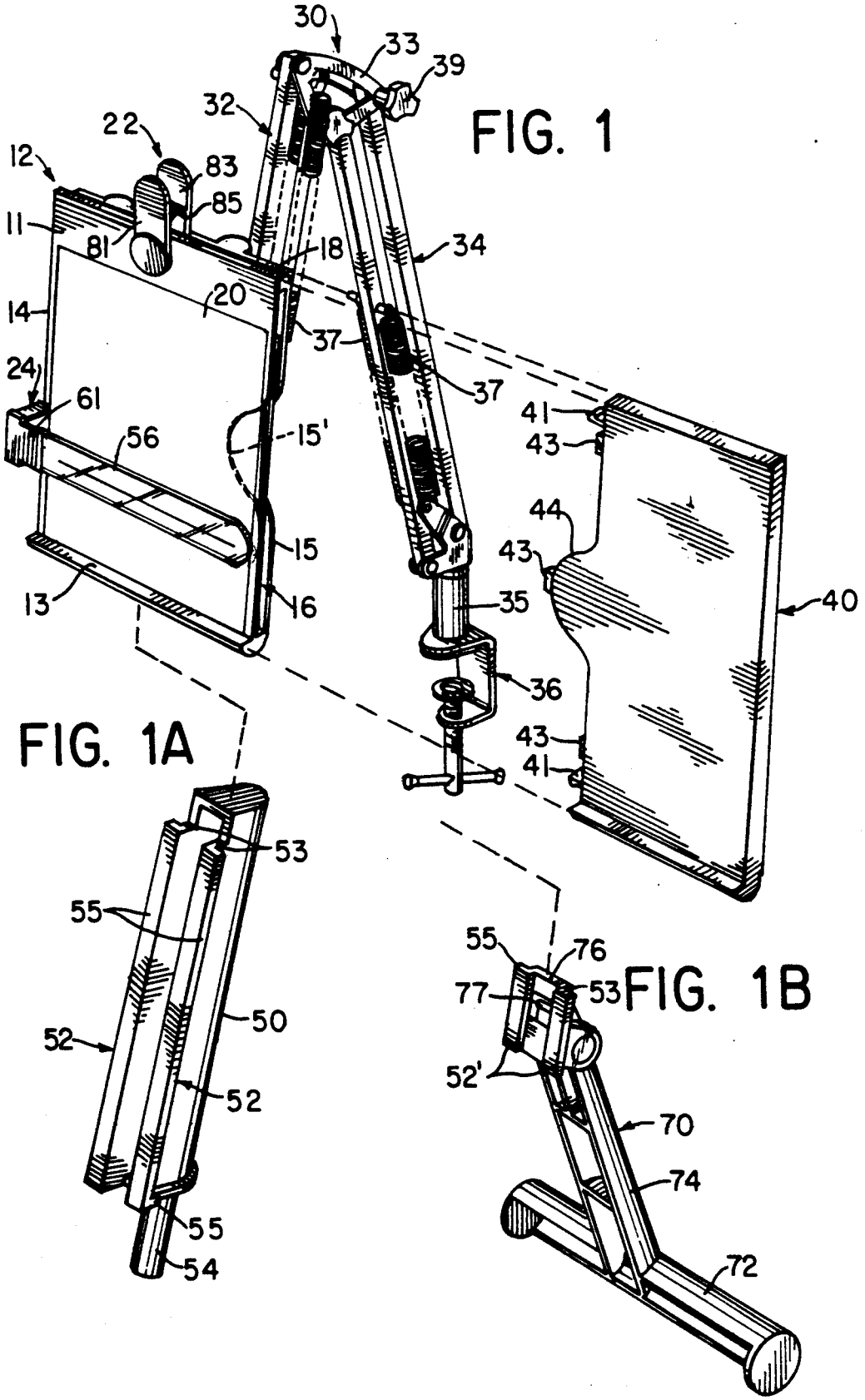
FIG. 1 is a partially exploded view of a copy holder according to the present invention, with FIG. 1A showing an elongated member for attachment of the holder to a swing arm and FIG. 1B showing an inverted T-shaped brace for supporting the holder on a desk top.

In FIG. 1 there is shown a swing arm copy holder according to the present invention. This copy holder has a copy support structure 12 with a main copy surface 11 on its front. A lip 13 runs along the bottom of surface 11 and acts to support a document 20 on the surface 11. To assist in holding the document to the surface 11, there is a large flexible clip 22. Also, a line guide 24 is slidably attached to a side 14 of the structure to indicate a position in the document.

In a preferred embodiment, structure 12 is hollow with its side 15 open. This provides a storage compartment 16 in the structure to hold documents for later use.

As shown in FIG. 1, the copy holder structure 12 has its back rotatably connected to a pair of arms 32 of swing arm support 30. This connection is by way of an elongated member 50 which has cylindrical projection 54 as shown in FIG. 1A. The projection 54 is received in a cylindrical recess of a bracket 31 (FIG. 9) such that it is capable of rotation about the axis of that cylindrical recess. Also, bracket 31 is pivotally connected to a further bracket 38 along the axle of knob 39, and bracket 38 is pivotally connected to arms 32 of swing arm 30.

The arms 32 are in turn connected by a bracket 33 to a further pair of arms 34 as shown in FIG. 1. A shelf mounting clamp 36 with a cylindrical portion 35 is pivotally connected to the ends of arms 34 which are remote from bracket 33. Cylindrical portion 35 allows the arms 32, 34, with the copy holder support 12 attached, to be rotated about the vertical axis of the cylinder, to a desired position. At the base of clamp 36 is a conventional C-clamp which allows it to be fastened to a shelf or other surface.

Because of the pivotal connections between clamp 36, arms 34, bracket 33, arms 32, bracket 38, bracket 31 and the copy support structure 12, the copy holder surface can be extended or retracted, tilted or rotated with respect to the clamp 36.

Springs 37 are located along the pairs of arms to stabilize the copy holder in position. One set of springs is between clamp 36 and one of the arms 34, while the other set of springs is between bracket 33 and one of the arms 32. Knobs 39 (FIGS. 1 and 9) can be tightened to halt the pivotal movement of the swing arm joints and keep the copy holder in a selected position.

Should it be desirable or necessary to support wide sheets of paper, such as that generated by a computer printer, an auxiliary copy support 40 can be snapped onto side 15 of the main copy support structure 12. Horizontal projections 41 and vertical projection 43 extend from support 40 and engaged recesses formed in the walls within the hollow compartment 16 at the open side 15 of the main copy support structure 12. This is shown in more detail in the broken away portion of FIG. 2.

Figure 2:
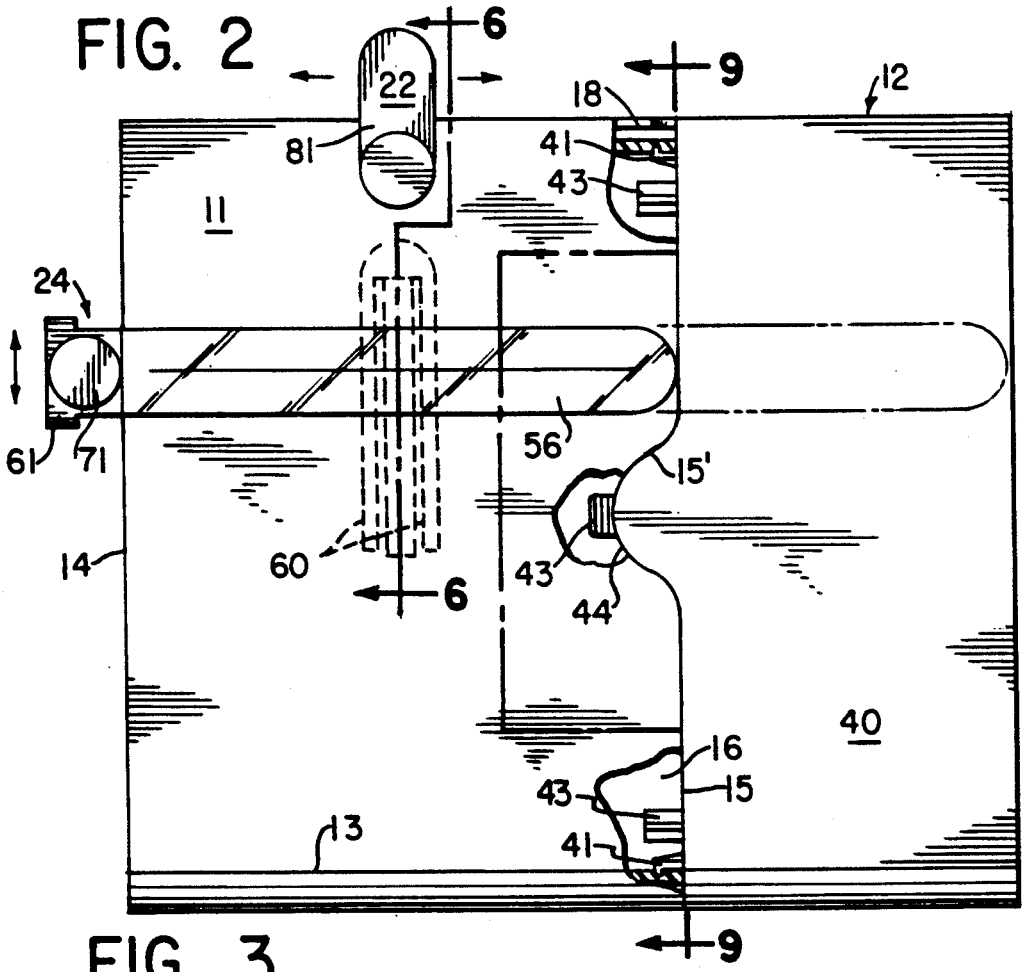
FIG. 2 is a front view, partially broken away, of the copy support surface of the copy holder with an auxiliary copy support surface attached to the main copy support surface.
Figure 3:
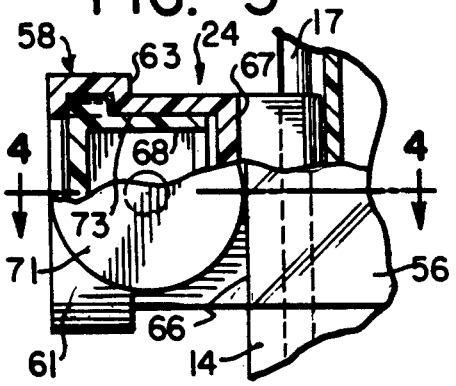
FIG. 3 is an enlarged view, partially sectioned, along line 3—3 of FIG. 4, showing the attachment of a line guide to the copy support structure.

The edge 15 of main copy support structure 12 has an indentation 15', which makes it easier to grasp documents in the compartment 16. The auxiliary structure 40 has a matching projection 44 so the two surfaces mate and fit flush, as shown in FIG. 2. Both of the structures, 12, 40, or at least the projections 42, 43 may be made of a flexible material, e.g. plastic, so that the projections may flex and ride along the inner surface of compartment 16 until they drop into the recesses. By applying a strong separation force between the structures 12, 40, the projections can be made to ride up out of the recesses in compartment 16 so that auxiliary structure 40 can be separated from main structure 12.

Figure 7:
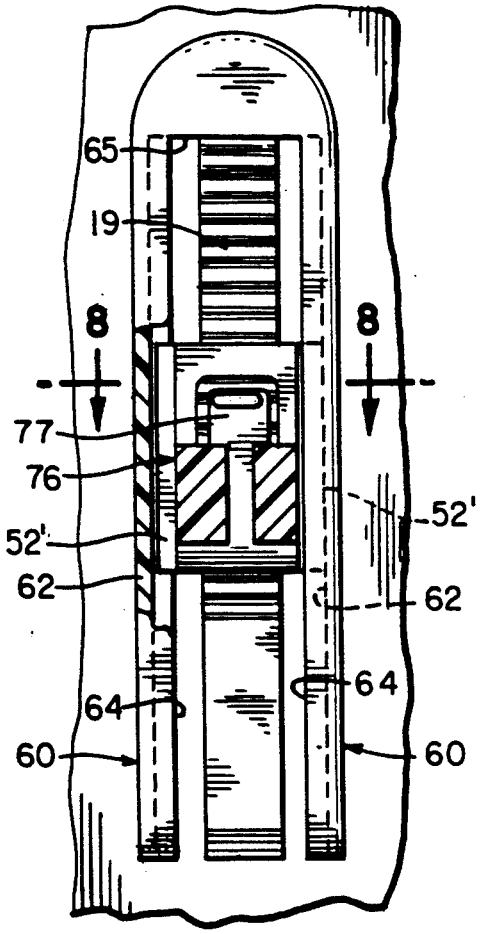
FIG. 7 is an enlarged view of a pair tracks on the back of the copy support structure, partially in section along line 7—7 of FIG. 6.
Figure 8:
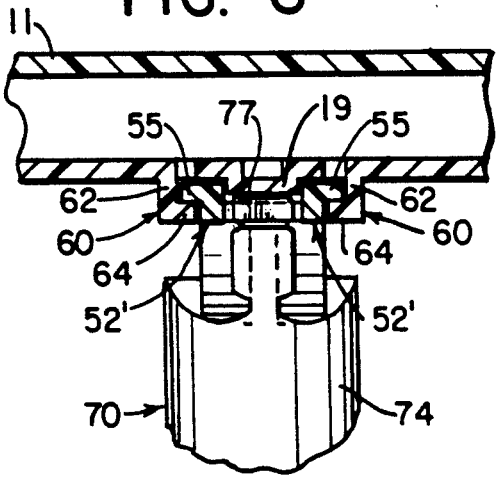
FIG. 8 is a sectional view along line 8—8 of FIG. 7 showing the attachment of the brace to the pair of tracks on the back of the copy support structure.
Figure 9:
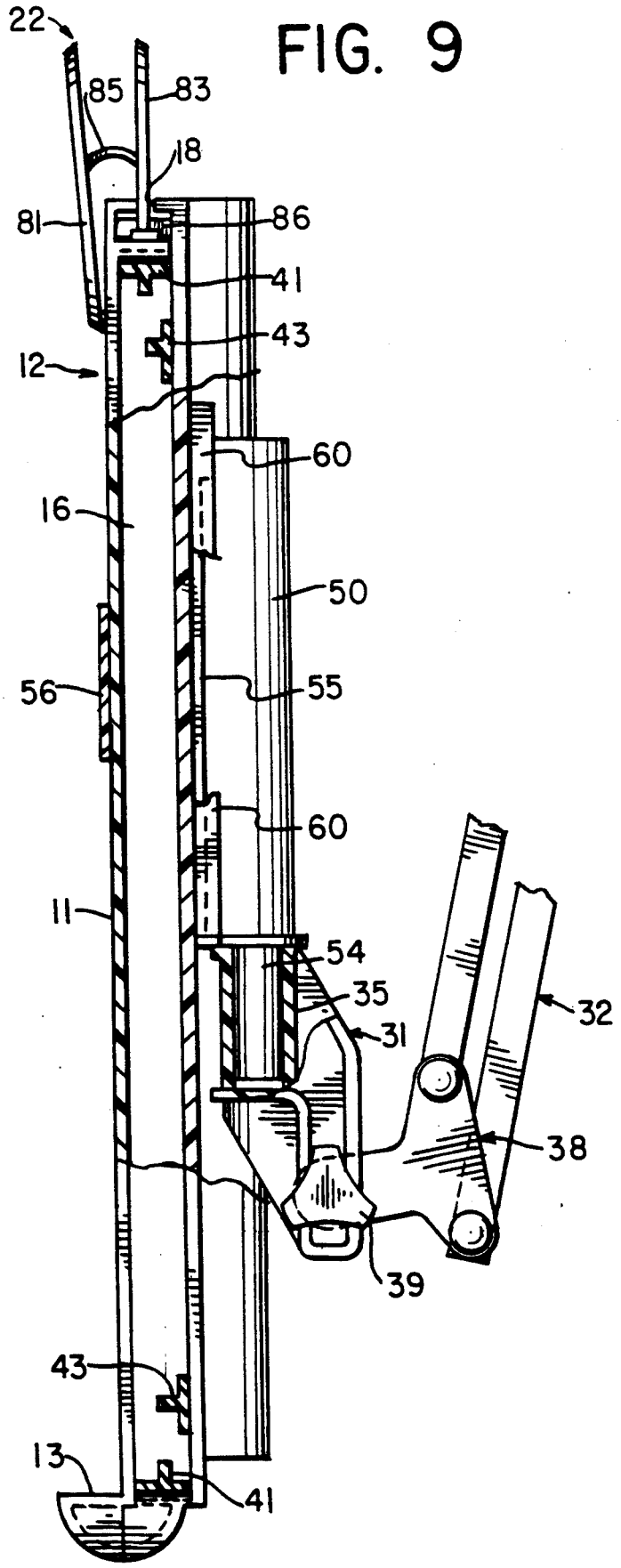
FIG. 9 is a cross-sectional view along line 9—9 of FIG. 2, which is the same as line 6—6, but showing the connection of the copy support structure to a swing arm.

As mentioned, the attachment of the swing arm 30 to the copy holder 12 is accomplished with the elongated member 50 shown in FIGS. 1A and 9. In addition there are a pair of tracks 60, shown in dotted line in FIG. 2 and in enlarged broken view in FIG. 7. Each track 60, as can be seen in FIG. 8, has an outward projection 62 with a lateral flange 64 at its end. Similarly, the member 50 has a pair of tracks 52 with outward projections 53 and lateral flanges 55 that interlock with the tracks 60 of the support (FIG. 1A). The tracks 60 are closed at their upper end by surface 65 (FIG. 7) and the tracks 52 are closed at their lower end by projections 55 (FIG. 1A). As a result, the tracks 52 of member 50 are slid onto the tracks 60 of the support 12 from the bottom and these members are slid with respect to each other until the top of tracks 52 engage the surface 65, thus securely holding the support to the elongated member 50.

As an alternative to connecting the copy support structure 12 to the swing arm 30 so as to form a swing arm copy holder, the present invention allows the copy support structure 12 to be connected to a desk top support brace 70 shown in FIG. 1B. This brace has an inverted T-shape with a generally cylindrical horizontal member 72 that rests on a surface and a generally vertical member 74 extending from approximately the midpoint of member 72. At the top of member 74, there is a pivotally connected bracket 76 having pairs of tracks 52' which are dimensioned like the tracks of elongated member 50 shown in FIG. 1A, i.e. with projections 53 and flanges 55. The major difference between the tracks 52' and the tracks 52 are that the tracks 52' are much shorter in length.

Figure 6:
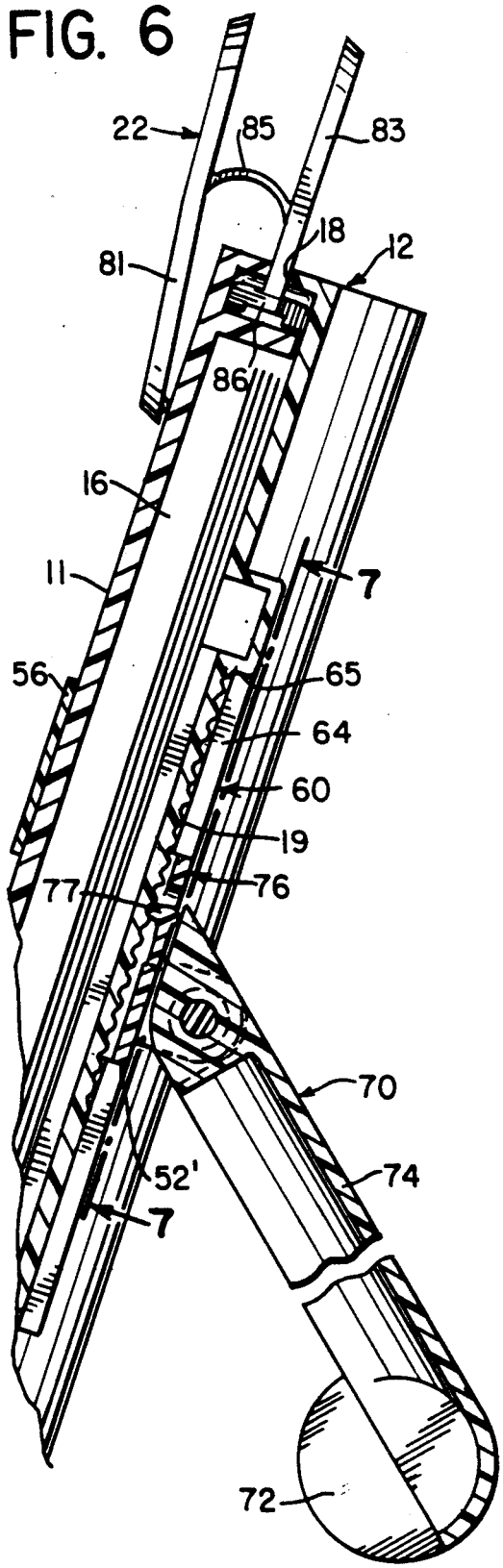
FIG. 6 is a side sectional view along line 6—6 of FIG. 2, showing the connection of the copy support structure to a brace for supporting it on a desk top.

Besides the tracks 52', bracket 76 also has a flexible finger 77 which engages the horizontal grooves 19 located on the back of copy support structure between tracks 60. As shown in FIGS. 6 and 7, when the tracks 52' of the desk top brace 70 are slipped onto the tracks 60 of the copy support, the finger 77 flexes to ride over the grooves until the desired angular position of copy surface 11 is reached. Then the engagement of finger 77 with the selected groove 19 will cause the copy holder to be held in that position, much like an easel.

It should be noted that while FIG. 8 shows a track interconnection for the desk top brace 70, exactly the same track interconnection exists when the elongated member 50 engages the track 60.

Figure 5:
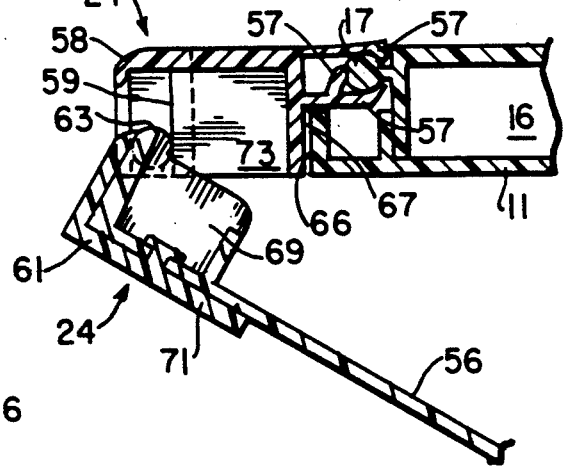
FIG. 5 is a sectional view similar to FIG. 4, but showing the line guide pivoted away from the copy surface.

As shown in FIG. 2, the line guide 24 includes a preferably transparent plastic straight-edge section 56 which may have a length equivalent to the width of ordinary stationary or a much longer length equivalent to the width of computer sheets. The longer width is shown in dot-dash lines in FIG. 2. This ruler portion is fastened to the edge 14 of the copy support structure by way of a sliding clamp portion 58. As best shown in FIG. 5, the edge 14 has a cylindrical rib 17 which is clasped by three projections 57 of clamp 58. The projections 57 may engage the rib 17 by sliding the line guide downward over the rib 17 from the top of the copy support structure. Lateral support of the clamp portion 58 on edge 14 is provided by contact between end wall 66 at the edge 14 of the copy support and end wall 67 on the clamp 58.

Figure 4:
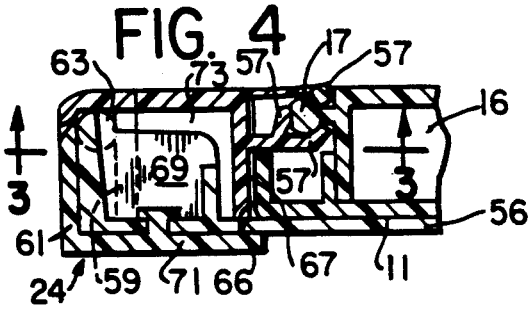
FIG. 4 is a sectional view along line 4—4 of FIG. 3, showing the attachment of the line guide to the copy support structure from a different angle.

Guide rule 56 is pivotally attached to clamp member 58 at axis 63, which axis is slidably received in a slot 59 of clamp 58. A bracket 61 has a locking projection 71 which engages a rear portion of guide rule 56 and forms a cap for it. This rear portion of guide rule 56 has a rectangular shape formed by orthogonal walls 68, 69 which extend away from the main portion of guide rule 56. These orthogonal walls are received within a recess 73 in clamp member 58 and provide additional stability to the guide rule 56 because of the contact between the walls 68, 69 and the interior walls of bracket 58 as shown in FIG. 4.

In normal operation the guide rule 56 rests on copy surface 11, but can be slid up and down edge 14 to indicate position within a document. When in this position the walls 68, 69 are within recess 73 as shown in FIG. 4. However, because of the pivotal connection 63, guide rule 56 can be pivoted away from copy surface to allow easy access to papers as shown in FIG. 5. Further, because axis 63 is free to travel in slot 59, as shown by the arrow in FIG. 5, the line guide will extend away from surface 11, while remaining parallel thereto, in order to accommodate thick papers. Thus, the line guide is self-adjusting to the thickness of the papers on the copy surface.

Another way of retaining long papers on copy surface 11, utilizes a clip 22. As best seen in FIG. 6, the clip has a long member 81 and a short member 83 which are held together by a spring member bridge 85. Member 85, which may be flexible plastic, tends to cause the ends of members 81, 83 to move towards each other, so as to clamp papers between them.

A channel 18 is provided at the upper edge of copy support structure 12. This channel receives the member 83 of clip 22, which has a flange 86 at its end. Because the channel 18 is narrow at its top, clip 22 must have its member 83 and flange 86 slipped into the channel from side 15 as shown in FIG. 1. As a result of the structural interconnection of clip 22 with copy support member 12, the clip is retained on the support, but can be slid along its upper surface by squeezing together the upper ends of members 81, 83. Space may be provided between member 81 and support surface 11 to accommodate a document. By releasing the upper ends of the members, the spring bridge 85 causes member 81 to press against the document holding it on surface 11.

While clip 22 may be made of any convenient materials, it is most economical to make the entire structure from flexible plastic material. Further other parts of the structure of the present invention may be made of flexible or rigid plastic as needed, or of other materials.

While the present invention has been particularly shown and described with reference to a preferred embodiment thereof, it will be readily understood by those skilled in the art that various changes in form and details may be made therein without the departing from the spirit and scope of the invention.

We claim:

1. A convertible copy holder comprising:

a copy support structure for supporting a document on a front copy support surface thereof, said structure having a pair of support tracks on a rear surface thereof, which support tracks have lateral projections extending toward a center axis of the support tracks, said support tracks being closed at a first end to form a stop at the upper end thereof;

an attachment means having a pair of attachment tracks on a forward surface thereof, which attachment tracks have lateral projections extending away from a center axis of the attachment means, which attachment tracks are further adapted to interlock with the support tracks while allowing sliding movement with respect up to said stop; and holder means for holding said attachment means, at least in part, in a selected position.

2. A convertible copy holder as claimed in claim 1 wherein the holder means is a swing arm comprising:

first, second and third brackets;

a shelf clamp for fastening the swing arm to a surface;

a first pair of arms pivotally connected together and to said clamp by said first bracket; and a second pair of arms pivotally connected together and to said attachment means by said second bracket, the third bracket pivotally connecting the first and second pairs of arms together.

3. A convertible copy holder as claimed in claim 2 wherein said clamp includes a cylindrical recess and said first bracket includes a cylindrical projection adapted to be received in the recess so as to permit rotation of said first bracket about the axis of the cylindrical recess in said clamp.

4. A convertible copy holder as claimed in claim 2 wherein said second bracket includes a cylindrical recess and said attachment means includes a cylindrical projection adapted to be received in the recess so as to permit rotation of said attachment means about the axis of the cylindrical recess in said second bracket.

5. A convertible copy holder as claimed in claim 2 further including first springs connected between said first bracket and said first pair of arms, and second spring connected between said third bracket and said second pair of arms to balance the force supplied to the swing arm by the copy support structure.

6. A convertible copy holder as claimed in claim 5 wherein said clamp includes a cylindrical recess and said first bracket includes a cylindrical projection adapted to be received in the recess so as to permit rotation of said first bracket about the axis of the cylindrical recess in said clamp and wherein said attachment means is an elongated member with said attachment tracks running along its length toward one side, said cylindrical projection extending from one end of the elongated member beyond the attachment tracks.

7. A convertible copy holder as claimed in claim 1 wherein said attachment means is a brace for partially supporting said copy support structure directly on a surface in easel fashion.

8. A convertible copy holder as claimed in claim 7 wherein said brace has an inverted T-shape with a first member adapted to engage the surface and a second member extending generally from the mid-part of the first member, the end of the second member being pivotally connected to said attachment means.

9. A convertible copy holder as claimed in claim 8 wherein said attachment means further includes a flexible finger projection between the attachment tracks, and wherein said copy support structure includes a plurality of horizontal grooves between the support tracks, said flexible finger being adapted to flexibly engage a selected groove when the support tracks and attachment tracks are interlocked.

10. A convertible copy holder as claimed in claim 1 further including an auxiliary copy support adapter to mate with a side edge of said copy support structure, said auxiliary copy support and said copy support structure having flexible projections and recesses adapted to interlock with each other when the auxiliary copy support and the copy support structure mate, and to releasibly hold them together.

11. A convertible copy holder as claimed in claim 1 wherein the copy support structure is hollow and is open at one end to provide a storage compartment.

12. A convertible copy holder as claimed in claim 1 wherein the copy support structure has a lip along one edge to support documents.

13. A convertible copy holder as claimed in claim 1 further including a line guide, said line guide having a clamp portion and a ruler portion, said copy support holder having a rib along one side edge which is engaged by said clamp portion, said ruler portion of said line guide being adapted to extend from said clamp portion across the copy support surface.

14. A convertible copy holder as claimed in claim 13 wherein said clamp portion has at least two parts pivotally connected together, one part engaging the rib and the other part supporting the ruler portion such that the ruler portion may be pivoted away from the copy support surface.

15. A convertible copy holder as claimed in claim 14 wherein the pivotal connection comprises an axle on one part received in a slot on the other part, such that the ruler portion may extend away from the copy support surface, while being generally parallel thereto, and the line guide is self-adjusting to accommodate the thickness of documents on the copy surface.

16. A convertible copy holder as claimed in claim 1 further including a document clip, said document clip having a long member and a short member with ends biased toward each other by a flexible bridge member, a lateral flange being located at the end of said short member, and further including a partially closed channel in one edge of said copy support structure adapted to have the short member extend into it and the flange to be slidably retained therein.

17. A copy holder comprising:

a copy support structure for supporting a document on a copy support surface thereof said copy support structure is hollow and is open at one end so as to create a compartment, said compartment having recesses in its walls about the open end;

an auxiliary support having an additional copy support surface for releasible attachment to and mating with said copy support structure so as to increase the available copy support surface area, said auxiliary support having flexible finger projections which enter the open end of said compartment and releasibly engage the recesses when the copy support structure and auxiliary support are brought into mating engagement with each other;

a holder means for holding the copy holder in a selected position; and an attachment means for connecting the copy support structure to said holder means.

18. A copy holder comprising:

a copy support structure for supporting a document on a copy support surface thereof, said structure having a rib along one edge thereof;

a holder means for holding the copy holder in a selected position;

an attachment means for connecting the copy support structure and said holder means;

a line guide having a ruler portion extending across said copy support surface and a clamp portion being in two parts pivotally connected to each other, with one part engaging the rib and the other part supporting said ruler portion so that said ruler portion may be pivoted away from the copy support surface; the pivotal connection comprises an axle on one part received in a slot on the other part, such that the ruler portion may extend away from the copy support surface, while being generally parallel thereto, and the line guide is self-adjusting to accommodate the thickness of documents on the copy surface.

19. A copy holder comprising:

a copy support structure for supporting a document on a copy support surface thereof, said structure having a partially closed channel along one edge thereof;

a holder means for holding the copy holder in a selected position;

an attachment means for connecting the copy support structure to said holder means; and a clip having first and second members with ends biased toward each other by a connecting bridge member, one member of said clip having a flange at its end, said channel of said copy support structure being adapted to receive said one member and to slidably retain its flange therein.

* * * * *